US010930299B2

(12) United States Patent
Lu et al.

(10) Patent No.: US 10,930,299 B2
(45) Date of Patent: Feb. 23, 2021

(54) AUDIO SOURCE SEPARATION WITH SOURCE DIRECTION DETERMINATION BASED ON ITERATIVE WEIGHTING

(71) Applicant: DOLBY LABORATORIES LICENSING CORPORATION, San Francisco, CA (US)

(72) Inventors: Lie Lu, San Francisco, CA (US); Mingqing Hu, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 495 days.

(21) Appl. No.: 15/572,067

(22) PCT Filed: May 12, 2016

(86) PCT No.: PCT/US2016/032189

§ 371 (c)(1),
(2) Date: Nov. 6, 2017

(87) PCT Pub. No.: WO2016/183367

PCT Pub. Date: Nov. 17, 2016

(65) Prior Publication Data

US 2018/0144759 A1 May 24, 2018

Related U.S. Application Data

(60) Provisional application No. 62/164,741, filed on May 21, 2015.

(30) Foreign Application Priority Data

May 14, 2015 (CN) ..... 201510247108.5

(51) Int. Cl.
*G10L 21/0308* (2013.01)
*G10L 25/18* (2013.01)
(Continued)

(52) U.S. Cl.
CPC ..... *G10L 21/0308* (2013.01); *G10L 19/008* (2013.01); *G10L 21/0272* (2013.01); *G10L 25/18* (2013.01); *G10L 21/0264* (2013.01)

(58) Field of Classification Search
CPC . H04S 3/008; G10L 21/0264; G10L 21/0272; G10L 21/0308; G10L 25/18
See application file for complete search history.

(56) References Cited

U.S. PATENT DOCUMENTS 5,583,951 A * 12/1996 Sirat ..... G06F 17/16 382/232
8,358,563 B2 1/2013 Hiroe
(Continued)

FOREIGN PATENT DOCUMENTS

WO 01/74117 10/2001

OTHER PUBLICATIONS

Zhou, G. et al "Mixing Matrix Estimation from Sparse Mixtures with Unknown Number of Sources" IEEE Transactions on Neural Networks, vol. 22, Issue 2, Feb. 2011, pp. 211-221.
(Continued)

*Primary Examiner* — Kyle R Quigley

(57) ABSTRACT

Example embodiments disclosed herein relate to audio source separation with source direction determined based on iterative weighted component analysis. A method of separating audio sources in audio content is disclosed. The audio content includes a plurality of channels. The method includes obtaining multiple data samples from multiple time-frequency tiles of the audio content. The method also includes analyzing the data samples to generate multiple components in a plurality of iterations, wherein each of the components indicates a direction with a variance of the data samples, and wherein in each of the plurality of iterations, each of the data samples is weighted with a weight that is determined based on a selected component from the multiple
(Continued)

components. The method further includes determining a source direction of the audio content based on the selected component for separating an audio source from the audio content. Corresponding system and computer program product of separating audio sources in audio content are also disclosed.

23 Claims, 6 Drawing Sheets

(51) Int. Cl.

| | |
|---|---|
| ***G10L 21/0272*** | (2013.01) |
| ***G10L 19/008*** | (2013.01) |
| *G10L 21/0264* | (2013.01) |

(56) References Cited

U.S. PATENT DOCUMENTS

| | | | | |
|---|---|---|---|---|
| 9,786,288 | B2 | 10/2017 | Hu | |
| 2005/0240642 | A1 | 10/2005 | Parra | |
| 2006/0206315 | A1 | 9/2006 | Hiroe | |
| 2008/0175394 | A1* | 7/2008 | Goodwin | H04S 3/008 381/1 |
| 2009/0043588 | A1 | 2/2009 | Takeda | |
| 2009/0190774 | A1 | 7/2009 | Wang | |
| 2009/0252341 | A1 | 10/2009 | Goodwin | |
| 2010/0070274 | A1 | 3/2010 | Cho | |
| 2010/0082340 | A1 | 4/2010 | Nakadai | |
| 2010/0138010 | A1 | 6/2010 | Aziz Sbai et al. | |
| 2010/0329466 | A1 | 12/2010 | Berge | |
| 2011/0249822 | A1 | 10/2011 | Jaillet | |
| 2011/0261977 | A1 | 10/2011 | Hiroe | |
| 2013/0297296 | A1 | 11/2013 | Yoo | |
| 2014/0226838 | A1 | 8/2014 | Wingate | |
| 2014/0355766 | A1 | 12/2014 | Morrell | |
| 2014/0372107 | A1 | 12/2014 | Vilermo | |
| 2017/0206907 | A1 | 7/2017 | Wang | |

OTHER PUBLICATIONS

Cruces-Alvarez, S. et al "An Iterative Inversion Approach to Blind Source Separation" IEEE Transactions on Neural Networks, vol. 11, No. 6, Nov. 2000, pp. 1423-1437.

Cichocki, A. et al "Adaptive Blind Signal and Image Processing" Learning Algorithms and Applications, John Wiley, Jun. 2002, pp. 1-588.

Ding, C. et al "R 1-PCA: Rotational Invariant L1-Norm Principal Component Analysis for Robust Subspace Factorization" Proc. of the 23rd International Conference on Machine Learning, Jan. 1, 2006, pp. 281-288.

Burnaev E.V. et al "On an Iterative Algorithm for Calculating Weighted Principal Components" Journal of Communications Technology and Electronics, vol. 60, No. 6, Jul. 12, 2015, pp. 619-624.

* cited by examiner

AUDIO SOURCE SEPARATION WITH SOURCE DIRECTION DETERMINATION BASED ON ITERATIVE WEIGHTING

CROSS-REFERENCE TO RELATED APPLICATIONS

This application claims priority to Chinese Patent Application No. 2015102471085, filed on May 14, 2015 and U.S. Provisional Patent Application No. 62/164,741, filed on May 21, 2015, each of which is incorporated herein by reference in its entirety.

TECHNOLOGY

Example embodiments disclosed herein generally relate to audio content processing, and more specifically, to a method and system for separating audio sources with source directions determined based on iterative weighted component analysis.

BACKGROUND

Audio content of a multi-channel format (such as stereo, surround 5.1, surround 7.1, and the like) is created by mixing different audio signals in a studio, or generated by recording acoustic signals simultaneously in a real environment. The mixed audio signal or content may include a number of different audio sources. Audio source separation is a task to identify individual audio sources and metadata such as directions, velocities, sizes of the audio sources, or the like. As used herein, the term "audio source" or "source" refers to an individual audio element that exists for a defined duration of time in the audio content. For example, an audio source may be a human, an animal or any other sound source in a sound field. The identified audio sources and metadata may be suitable for use in a great variety of subsequent audio processing tasks. Some examples of the audio processing tasks may include spatial audio coding, remixing/re-authoring, 3D sound analysis and synthesis, and/or signal enhancement/noise suppression for various purposes (for example, the automatic speech recognition). Therefore, improved versatility and better performance can be achieved by successful audio source separation.

Mixed audio content can be generally modeled as a mixture of one or more audio sources panned to multiple channels by respective coefficients. Panning coefficients of an audio source may represent a panning direction of the source (also referred to as a source direction) in a space spanned by the mixed audio content. The source directions and the number of the source directions (which is equal to the number of audio sources to be separated) can be estimated first during the task of audio source separation (with the mixed audio content observed) in order to identify audio sources therein.

In a conventional solution, the number of source directions is preconfigured by experience and respective source directions are estimated by random initialization and iterative update based on the predetermined number of source directions. However, this requires significant efforts such as iterative updates to obtain reasonable values for the source directions if the source directions are randomly initialized. Moreover, low performance of audio source separation is achieved in the conventional solution since the source direction determination is subject to the preconfigured number of source directions, which number may be different from the number of audio sources actually contained in the mixed audio content.

SUMMARY

In general, example embodiments disclosed herein propose a method and system of separating audio sources in audio content.

In one aspect, example embodiments disclosed herein provide a method of separating audio sources in audio content. The audio content includes a plurality of channels. The method includes obtaining multiple data samples from multiple time-frequency tiles of the audio content. The method also includes analyzing the data samples to generate multiple components in a plurality of iterations, wherein each of the components indicates a direction with a variance of the data samples, and wherein in each of the plurality of iterations, each of the data samples is weighted with a weight that is determined based on a selected component from the multiple components. The method further includes determining a source direction of the audio content based on the selected component for separating an audio source from the audio content. Embodiments in this regard further provide a corresponding computer program product.

In another aspect, example embodiments disclosed herein provide a system of separating audio sources in audio content. The audio content includes a plurality of channels. The system includes a data sample obtaining unit configured to obtain multiple data samples from multiple time-frequency tiles of the audio content. The system also includes a component analysis unit configured to analyze the data samples to generate multiple components in a plurality of iterations, wherein each of the components indicates a direction with a variance of the data samples, and wherein in each of the plurality of iterations, each of the data samples is weighted with a weight that is determined based on a selected component from the multiple components. The system further includes a source direction determination unit configured to determine a source direction of the audio content based on the selected component for separating an audio source from the audio content.

Through the following description, it would be appreciated that in accordance with example embodiments disclosed herein, iterative weighted component analysis is performed on the data samples obtained from input audio content and weights for the data samples are updated in each iteration. One of the components generated by the component analysis can be moved to a real source direction after multiple iterations. The direction of this component is then determined as a source direction. The iterative weighted component analysis can effectively detect dominant source directions in the input audio content and is suitable for any multi-dimensional audio content. Other advantages achieved by example embodiments disclosed herein will become apparent through the following descriptions.

DESCRIPTION OF DRAWINGS

Through the following detailed description with reference to the accompanying drawings, the above and other objectives, features and advantages of example embodiments disclosed herein will become more comprehensible. In the drawings, several example embodiments disclosed herein will be illustrated in an example and non-limiting manner, wherein.

Throughout the drawings, the same or corresponding reference symbols refer to the same or corresponding parts.

DESCRIPTION OF EXAMPLE EMBODIMENTS

Figure 1:
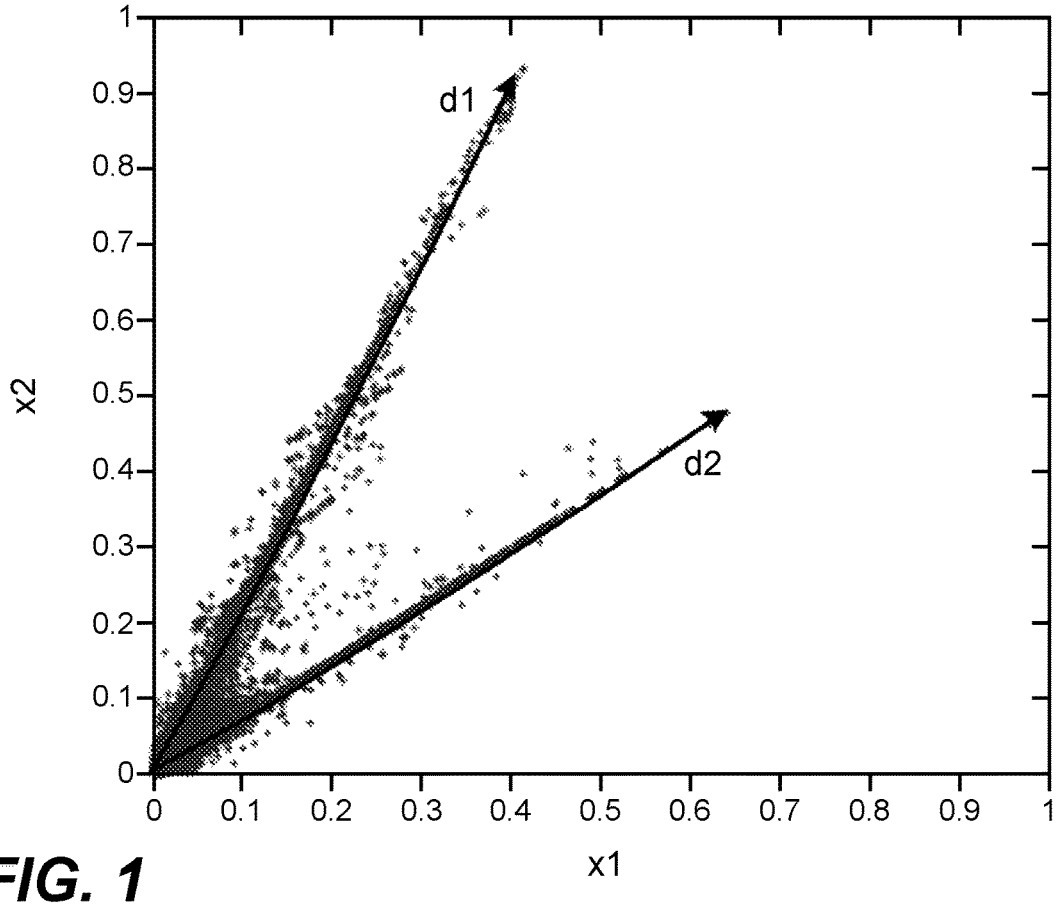
FIG. 1 illustrates a schematic diagram of a scatter plot of a stereo audio signal in accordance with an example embodiment disclosed herein.

Principles of example embodiments disclosed herein will now be described with reference to various example embodiments illustrated in the drawings. It should be appreciated that depiction of these embodiments is only to enable those skilled in the art to better understand and further implement example embodiments disclosed herein, not intended for limiting the scope disclosed herein in any manner.

As mentioned above, it is desired to determine source directions from audio content so as to perform source separation on the audio content. The number of the determined source directions may also be utilized in the source separation.

Generally the source separation problem can be represented by the following mixed model:

$$x_i(t) = \sum_{j=0}^{N} a_{ij} s_j(t) + b_i(t),\ i = 1, 2, \ldots, M \tag{1}$$

where $x_i(t)$ represents an observed audio signal in a channel i of mixed audio content at a time frame t, $s_j(t)$ represents an unknown source signal j, $a_{ij}$ represents a panning coefficient from the source signal $s_j(t)$ to the mixed audio signal $x_i(t)$, $b_i(t)$ represent an uncorrelated component without obvious direction, such as noise and ambiance, N represents the number of underlying source signals, and M represents the number of the observed signals in the audio content and usually corresponds to the number of channels in the audio content. N is larger than or equal to 1, and M is larger than or equal to 2.

Written in a matrix format, Equation (1) becomes:

$$X(t)=A\cdot S(t)+b(t) \tag{2}$$

where X(t) represents the mixed audio content with M observed signals at a time frame t, S(t) represents N unknown source signals mixed in the audio content, and A represents an M-by-N panning matrix containing panning coefficients. Each column in the matrix A, for example, $[a_{1j}, a_{2j}, \ldots, a_{Mj}]^T$, is referred to as a source direction of the source signal $s_j(t)$ in a space spanned by the observed signals.

According to the mixed model above, the panning matrix A can be constructed first in order to separate audio sources from the audio content. That is, one or more of the source directions in the matrix A may be estimated as well as the number of the source directions M.

The source direction estimation is generally based on the sparsity assumption, which assumes that there are sufficient time-frequency tiles of audio content where only one active or dominant audio source exists. This assumption can be satisfied in most cases. Therefore, those time-frequency tiles with only one dominant source can be used to represent the source direction (or panning direction) of that audio source since there is not much noise disturbing the direction estimation. If a multi-dimensional data sample is obtained from each of the time-frequency tiles across multi-channels and all data samples are plotted in a multi-dimensional space where each dimension represents one of the observed signals (for example, one channel), there will be a number of data samples allocated around dominant source directions. By analyzing this scatter plot, the dominant source directions can be determined as well as the number of dominant sources.

FIG. 1 depicts an example scatter plot of a stereo audio signal that contains two sparse sources. The audio signal is divided into frames and then the amplitude spectrum of each frame is computed to obtain multiple data samples through, for example, conjugated quadrature mirror filterbanks (CQMF). Each of the data samples is two dimensional in this case, representing the amplitudes of signal $x_1$ (the left channel) and signal $x_2$ (the right channel) at a specific frequency bin and a specific frame. Note that the amplitude of each data sample is normalized in a range of 0 to 1 in FIG. 1. It can be clearly seen that there are two dominant source directions, as denoted by d1 and d2 in FIG. 1.

It is desired to determine the domain source directions from the multi-dimensional space. One simple method is to search the multi-dimensional space to find possible directions in the space that corresponds to dominant audio sources. However, this method may only work for the stereo signal in some cases since the search space is small. For example, in FIG. 1, a source direction can be represented as an angle from the horizontal axis, which is in a range from 0 to $\pi/2$ (in the case where the original spectrum instead of amplitude spectrum is used in the scatter plot, the angle can be from 0 to 7). Thus dividing this range to several slots (for example, 100) will achieve high resolution for dominant source direction estimation. In another word, at most only 100 directions need to be searched to find the dominant source directions. However, for the audio signal including a higher number of channels (for example, a 5.1 surround signal, a 7.1 surround signal, and the like), the search space would be dramatically increased to $10^8$ and $10^{12}$, which would be very challenging for the search method.

Example embodiments disclosed herein propose a solution that is suitable for efficiently estimating dominant source directions from an audio signal having any number of channels, including but not limited to a stereo signal, a 5.1 surround signal, a 7.1 surround signal, and the like. Based on the estimated source directions and the number of the estimated source directions, audio sources can be separated from the audio content based on the mixed model discussed above.

Figure 2:
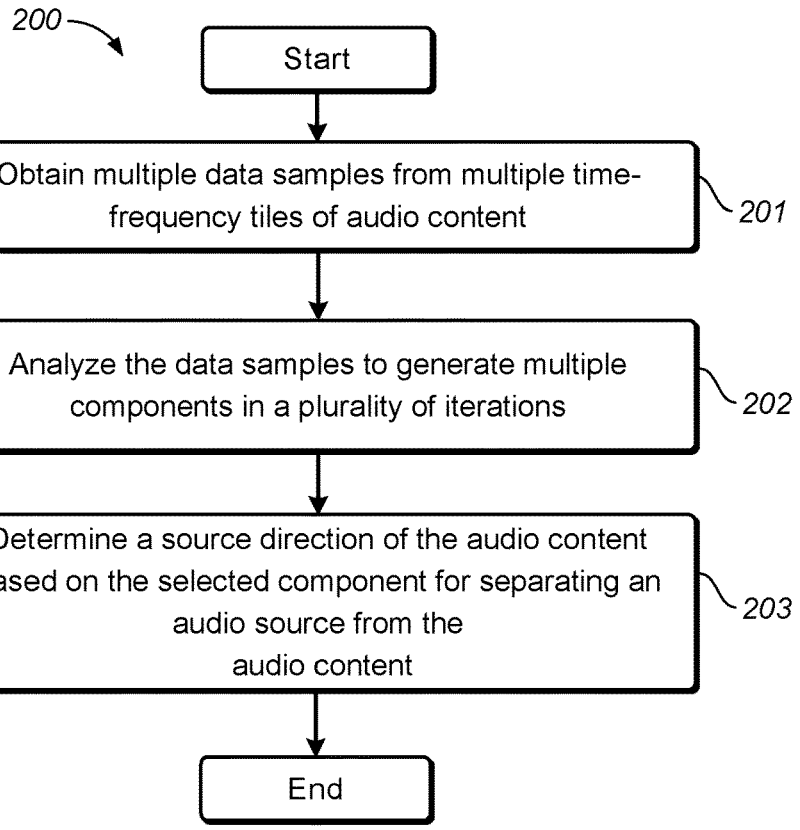
FIG. 2 illustrates a flowchart of a method of separating audio sources in audio content in accordance with an example embodiment disclosed herein.

Reference now is made to FIG. 2, which depicts a flowchart of a method of separating audio sources in audio content 200 in accordance with an example embodiment disclosed herein.

At step 201, multiple data samples are obtained from multiple time-frequency tiles of audio content.

The audio content to be processed is of a format based on a plurality of channels. For example, the audio content may conform to stereo, surround 5.1, surround 7.1, or the like. The audio content includes multiple mono signals from the respective channels. In some embodiments, the audio content may be represented as frequency domain signal. Alternatively, the audio content may be input as time domain signal. In those embodiments where the time domain audio signal is input, it may be necessary to perform some preprocessing to obtain the corresponding frequency domain signal.

The source direction estimation in embodiments disclosed herein is based on the sparsity assumption. In this sense, the audio content may be processed to obtain data samples in time-frequency tiles of the audio content. In some embodiments, when the input multichannel audio content is of a time domain representation, it may be divided into a plurality of blocks using a time-frequency transform such as conjugated quadrature mirror filterbanks (CQMF), Fast Fourier Transform (FFT), or the like. In some embodiments, each block typically comprises a plurality of samples (for example, 64 samples, 128 samples, 256 samples, or the like). Furthermore, the full frequency range of the audio content may be divided into a plurality of frequency sub-bands (for example, 77), each of which occupies a predefined frequency range. Therefore, a number of data samples may be obtained in the plurality of frequency sub-bands and in the plurality of sampling timings. Each data sample may represent an audio signal on each time-frequency tile of the audio content. In some embodiments disclosed herein, each data sample is multi-dimensional, representing the amplitude of respective channels of the audio signal at a specific frequency bin and a specific frame. The data samples may be plotted on a multi-dimensional space with each dimension corresponding to one of the channels of the audio content.

It is noted that any audio sampling method, either currently existing or future developed, may be used to obtain multiple data samples from the audio content. The scope of the subject matter disclosed herein is not limited in this regard.

At step 202, the data samples are analyzed to generate multiple components in a plurality of iterations.

In accordance with embodiments disclosed herein, a component analysis is performed on the obtained data samples to estimate source directions statistically.

In one example embodiment disclosed herein, a principal component analysis (PCA) approach is adopted to extract multiple principal components of a set of multi-dimensional data samples by a variance or covariance analysis. The first principal component represents the direction of the highest variance of the set, while the second principal component represents a direction of the second highest variance that is orthogonal to the first principal component. This can be naturally extended to obtain the required number of principal components which together span a component space covering the desired amount of variance. PCA may be considered as fitting an M-dimensional ellipsoid to the set of M-dimensional data samples, where each axis of the ellipsoid represents a principal component. If an axis of the ellipsoid is small, then the variance along that axis is small. If an axis of the ellipsoid is large, then the variance along that axis is also large.

The component analysis is used to analyze the data samples of the audio content by means of statistics, so as to identify the directions with corresponding variances. The generated multiple components may be used to represent the data samples in terms of the variance or covariance. The number of the components may be corresponding to the number of channels of the audio content in one embodiment.

In some embodiments, PCA analysis generally includes two steps. First, a covariance matrix of the data samples may be calculated. The covariance matrix may be represented in one example as:

$$C=(X-\overline{X})(X-\overline{X})^T \tag{3}$$

where C represent the covariance matrix, X represents the matrix formed by all the data samples, and $\overline{X}$ represents the mean of all the data samples. The matrix X may be written as $X=[x_1, x_2, \ldots, x_M]^T$, where M represents the number of channels of input audio content (also corresponding to the number of observed signals in the audio content). Each row of the matrix X, for example, $x_j$, is a K-dimensional vector, where K is the number of data samples obtained from the observed signal $x_j$ of the audio content. Therefore, the matrix X is an M-by-K matrix. In some embodiments, the mean matrix $\overline{X}$ may be omitted from Equation (3), and the covariance matrix may be simply represented as $C=XX^T$.

At the second step of PCA analysis, eigenvectors and eigenvalues of the calculated covariance matrix may be determined to obtain the principal components. The eigenvectors $V=[v_1, v_2, \ldots, v_M]$ may be interpreted as the directions of the principal components, and the eigenvalues $A=[\lambda_1, \lambda_2, \ldots, \lambda_M]$ may indicate the strengths (also corresponding to the variances) of the respective directions, with $\lambda_1 \geq \lambda_2 K \geq \lambda_M$. Generally $v_1$ and $\lambda_1$ represent the direction of the first principal component and the strength (or variance) of this direction respectively, $v_2$ and $\lambda_2$ represent the direction of the second principal component and the strength (or variance) of this direction respectively, and so on. The amplitude of a strength or variance of a component may be in direct proportion to the corresponding eigenvalue.

Figure 3:
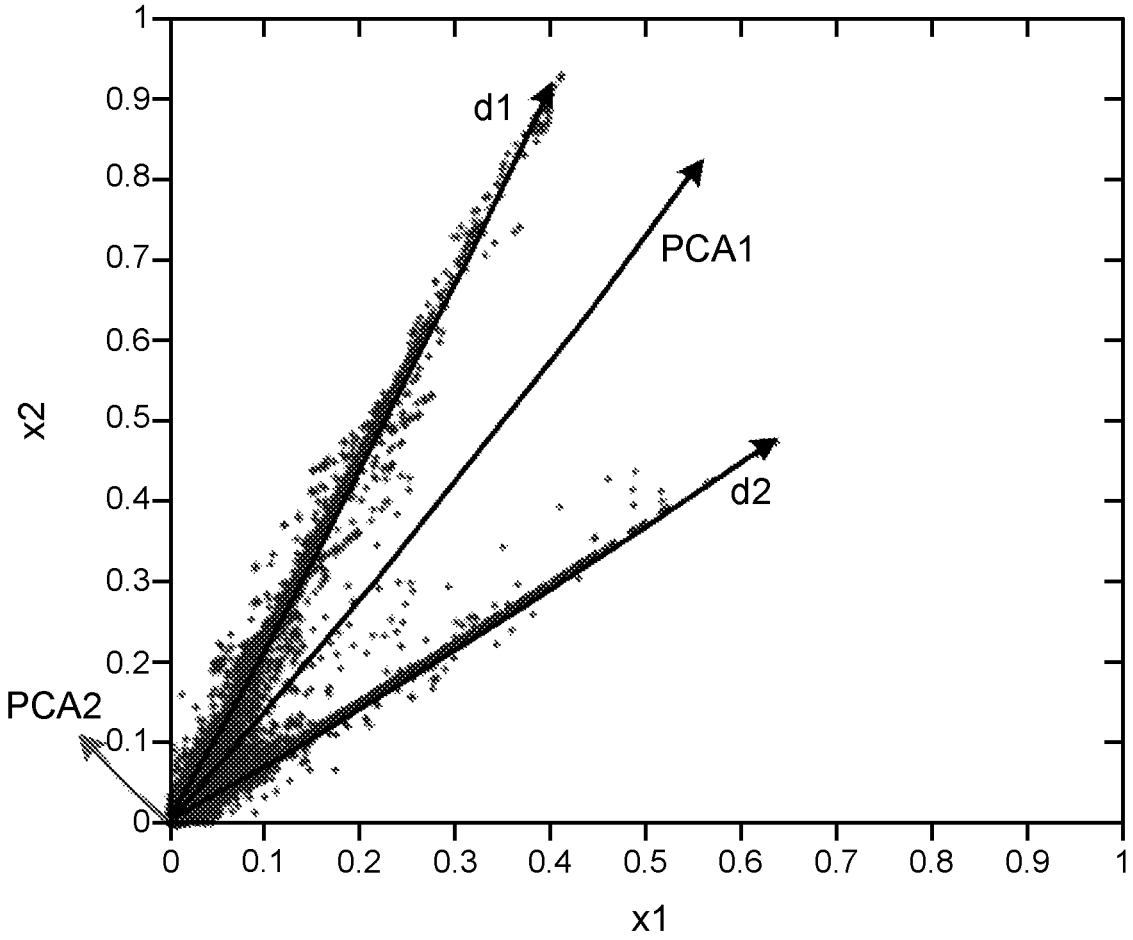
FIG. 3 illustrates a schematic diagram of a scatter plot of a stereo audio signal in accordance with another example embodiment disclosed herein.

Generally, by directly applying PCA to the original data samples of input audio content is not suitable for source direction estimation. Still take the data samples of the stereo signal in FIG. 1 as an example. By applying PCA to the data samples, the direction of the first principal component PCA1 may most likely be located at somewhere between the directions d1 and d2 as shown in FIG. 3. This is because the first principal component should indicate a direction with the strongest strength of all the data samples according to the PCA analysis. The direction of the second principal component PCA2 is orthogonal to the first principal component, which is also not a desirable source direction.

In view of the above, rather than directly applying component analysis to the data samples, an iterative weighted component analysis is proposed herein. With the iterative weighted component analysis, a selected component from the multiple generated principal components, typically the first principal component, can be gradually converged to one of the dominant source directions after multiple iterations.

In accordance with embodiments disclosed herein, each of the data samples is weighted with a weight in each of the plurality of iterations. The weight (referred to as an adjusting weight hereinafter) is determined based on a selected component generated in each iteration and used to adjust the amplitude (or strength) of that data sample. In some embodiments, data samples close to the selected component are weighted by high weights, and other data samples are weighted by small weights in each round of iteration. That is, an adjusting weight applied to each data sample may indicate closeness (also referred to as correlation) of a direction of the data sample to the direction of the first principal component. In a next round of iteration, the component analysis is performed on the weighted data samples and the first principal component may move to a different direction that may be closer to a real source direction.

Referring to FIG. 3, it is desired to move one of the directions of the principal components (PCA1, for example) to one of the directions of dominant audio sources (d1, for example). According to the proposed solution herein, high weights may be first applied to data samples close to PCA1, and small weights may be applied to other data samples. Then PCA analysis is re-applied to the weighted data samples in a next round of iteration. The direction of the re-generated principal component PCA1 may be rotated towards the direction d1 in this example. After several rounds of iteration, PCA1 may be converged to d1, and then the source direction may be obtained.

In some embodiments where PCA is performed, the selected component may be the first principal component indicating a direction with the largest variance of the data samples in each iteration. Generally if the first principal component is selected in the first iteration, this component may also be the one indicating the direction with the largest strength (variance) in the subsequent iterations due to the weighting process. In some other embodiments, other components from the generated multiple components may also be selected to be used as a basis of the weight determination. The use of the component with a higher variance, such as the first principal component may reduce the time for convergence in some use cases.

It is noted that strengths of the components generated after the component analysis are generally sorted in a descending order. For example, the eigenvalues representing strengths of the components are sorted in a descending order as $A=[\lambda_1, \lambda_2, \ldots, \lambda_M]$, with $\lambda_1 \geq \lambda_2 K \geq \lambda_M$. The selected component may be the one corresponding to the same order of strength in the eigenvalue sequence although the values of direction and strength of this component are changed after each iteration. For example, in each of the multiple iterations of PCA analysis, the first principal component (with the eigenvalue $\lambda_1$) is always selected for the basis of updating the adjusting weight.

The process of iterative weighted PCA and the determination for weight will be described in details below.

It should be noted that the example embodiments disclosed herein are not intend to limit the how to perform component analysis, many other approaches may be used to generate a plurality of components well representing the data samples.

In many cases, due to the data asymmetry at the left/right side of a component (for example, the selected component), the iterative reweighting process can usually make a regenerated component gradually converge to one real dominant source direction after a few iterations. In the case where the data samples at two sides of the selected component is strictly symmetric, the selected component may remain unchanged after weighting the data samples. In this case, a predetermined offset value may be added to the selected component in one of the plurality of iterations in some embodiments, so as to keep moving the component towards a real source direction. It would be appreciated that the offset value may be set as any random small delta so as to break the symmetry of the data samples.

Referring back to FIG. 2, the method 200 then proceeds to step 203. At step 203, a source direction of the audio content is determined based on the selected component for separating an audio source from the audio content.

After the plurality of iterations as discussed with respect to step 202, the direction of the selected component can be gradually converged to the real source direction of a dominant audio source in the audio content. Compared with the direction of the selected component generated in the first iteration, this direction may be more reliable for audio source separation as it becomes more close to the real source direction after several rounds of PCA analysis, with the data samples weighted in each iteration. Therefore, one source direction of the audio content is determined as the direction indicated by the selected component in some embodiments. The amplitude (or strength) of the selected component may also be determined as the amplitude (or strength) of the source direction in some embodiments.

The determined source direction may be used to construct the panning matrix A so as to extract audio sources from the mixed model represented in Equations (1) and (2). It is noted that when one source direction is obtained according to the iterative weighted process as discussed above, other source directions contained in the panning matrix may be estimated by other methods or may be initialized as random values. In this case, the number of source directions may be predetermined. The scope of the subject matter disclosed herein is not limited in this regard.

In some further embodiments disclosed herein, the iterative weighted process as discussed above may be iteratively performed so as to obtain multiple source directions for audio source separations. In each iteration, data samples along the previously-obtained source directions may be masked or suppressed in order to reduce their impacts on the estimation of a next source direction. The determination for multiple source directions will be described below.

The proposed iterative weighted direction estimation can be suitable for not only stereo signals, but also signals including a higher number of channels, such as 5.1 surround signals, 7.1 surround signals, and the like. The difference between direction estimations for audio signals including different number of channels lies in that PCA analysis is applied on covariance matrices with different number of dimensions, which increases less computation efforts. For example, for a stereo signal with a left channel and a right channel, PCA is applied on the corresponding 2-by-2 covariance matrix. While for a 5.1 surround signal with 6 channels, the difference is that PCA is applied to the corresponding 6-by-6 covariance matrix (or a 5-by-5 covariance matrix if the low frequency enhancement (LEF) channel is discarded in some realistic implementations).

Figure 4:
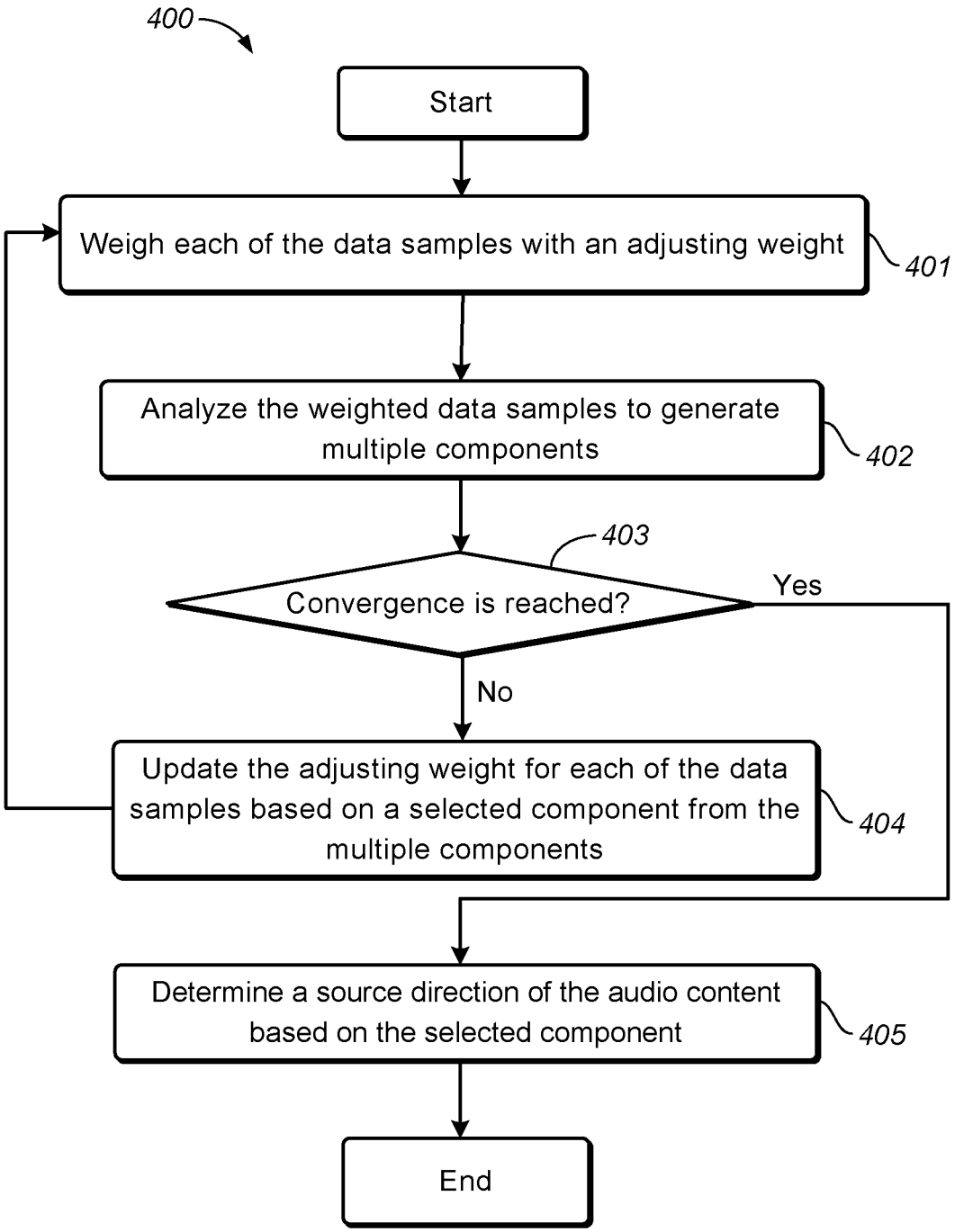
FIG. 4 illustrates a flowchart of a process for determining a source direction of audio content in accordance with an example embodiment disclosed herein.

FIG. 4 depicts a flowchart of a process for determining a source direction of audio content 400 in accordance with an example embodiment disclosed herein. Specifically, the process for determining the source direction 400 is based on the iterative weighted method 200 as discussed above. The process 400 may be considered as a specific implementation of steps 202 and 203 in the method 200.

As shown, the process 400 is entered at step 401, where each of the data samples is weighted with an adjusting weight. In each iteration of the process 400, the data samples to be weighted are those obtained from the input audio content. In the first iteration, since no component analysis is performed and no component is generated yet, in one embodiment, adjusting weights for all the data samples may be initially set as 1.

In some further embodiments disclosed herein, an adjusting weight for each data sample may be initialized based on the strength (or amplitude or loudness in some examples) of the data sample. This is because the directions of the data samples with higher strengths are more distinctive, while the data samples close to the origin of the coordinate system in the multi-dimensional space are more prone to noise interference and may be not reliable for direction estimation. In some embodiment, the adjusting weight for each data sample may be positively related to the strength of the data sample. That is, the higher the strength of a data sample, the larger the adjusting weight is. In one example, an adjusting weight for a data sample p may be initialized as below:

$$w_p = c|p|^{\alpha_i} \tag{4}$$

where $w_p$ represents an adjusting weight for a data sample p, |p| represents the strength of the data sample p, $\alpha_i$ represents a scaling factor, and c represents a normalized coefficient used to avoid or reduce the impact of outlier data samples. The scaling factor is typically smaller than 1. It is noted that there are many other ways to initialize an adjusting weight based on the strength of a data sample, and the scope of the subject matter disclosed herein is not limited in this regard.

In the first iteration of the process 400, the original data samples may be weighted by respective initialized adjusting weights. In the subsequent iterations, the original data samples may be weighted by respective updated adjusting weights, which will be described below.

At step 402, the weighted data samples are analyzed to generate multiple components in each iteration.

In one embodiment, a PCA analysis method may be applied on the weighted data samples to generate multiple principal components. In one example, the covariance matrix computed during the PCA analysis may be represented as below:

$$C = (X - \overline{X})WW^T(X - \overline{X})^T \tag{5}$$

where W represents an adjusting weight matrix for all the data samples, containing the weights determined for the respective data samples.

As mentioned above, a component indicates a direction with a variance of the weighted data samples. The first principal component generated after the PCA analysis indicates the direction with the largest variance of the weighted data samples and each principal component is orthogonal to each other.

At step 403, it is determined whether a convergence condition is reached. If the convergence condition is reached (Yes at step 403), the iterative process 400 proceeds to step 405. If the convergence condition is not reached (No at step 403), the process 400 proceeds to step 404.

In some embodiments disclosed herein, the convergence condition may be based on correlations of the generated multiple components and the weighted data samples. In these embodiments, a correlation between each of the generated multiple components and the weighted data samples may be determined, and the correlation of the selected component based on which the adjusting weight is updated may be compared with correlations of other components. A correlation may be determined based on differential angles between a direction indicated by a given component and respective directions of the weighted data samples in the cases where the strength of the component and the weighted data samples are all normalized. A small differential angle means that a data sample is close to the given component, and the correlation between the data sample and the given component is high. That is, the correlation may be negatively related to the differential angles. In one example, the correlation of the given component and all the data samples may be calculated as a sum of cosine values of the differential angles between the given component and respective data samples. For each of the generated multiple components, the corresponding correlation may be determined.

When there is a large difference (for example, larger than a threshold) between the correlation of the selected component and those of other components, it means that the original data samples have been weighted properly so that the selected component is rotated to close to a real dominant source direction. In this case, the iterative process 400 is converged.

In some embodiments disclosed herein, if the multiple components generated in the current iteration remain substantially unchanged compared with those generated in a previous generation, it is determined that the iterative process 400 may be converged.

In some other embodiments disclosed herein, the convergence condition may be based on a predetermined number of iterations, for example, 3, 5, 10, or the like. If a predetermined number of iterations are performed, the convergence condition is satisfied and the process 400 proceeds to step 405.

It is noted that the iterative process 400 may be converged based on any other convergence conditions, and the scope of the subject matter disclosed herein is not limited in this regard.

If the convergence condition is reached at step 403, the process 400 proceeds to step 405, where a source direction of the audio content is determined based on the selected component. This step is corresponding to step 203 in the method 200, the description of which is omitted here for purpose of simplicity. The process 400 ends after step 405.

If the iterative process 400 is not converged at step 403, the process 400 proceeds to step 404. At step 404, the adjusting weight for each of the data samples is updated based on the selected component from the multiple components generated in the current iteration at step 402.

In one example, the selected component may be the first principal component when PCA analysis is performed on the data samples. In other examples, the selected component may be any of the generated components.

The updated adjusting weight is used in the weighting at step 401 in a next iteration. In some embodiments disclosed herein, the adjusting weight for each of the data samples may be updated based on a correlation between a direction of the data sample and a direction indicated by the selected component. As mentioned above, the correlation may be determined based on a differential angle between the two directions. A large correlation may indicate that the data sample is close to the selected component, and then a high adjusting weight may be applied to this data sample. In another word, the adjusting weight is positively related to the correlation.

In one embodiment, an adjusting weight for a data sample may be computed with an exponential function, which may be represented as below:

$$w_p^{(i+1)} = e^{-\alpha_2\left(1 - \frac{|p \cdot v^{(i)}|}{|p||v^{(i)}|}\right)^2} \tag{6}$$

where $w_p^{(i+1)}$ represents an adjusting weight for a data sample p in the (i+1)-th iteration and i is larger than or equal to 1. $v^{(i)}$ represents a selected component generated in the i-th iteration, for example, the first principal component when PCA analysis is performed.

$$\frac{|p \cdot v^{(i)}|}{|p||v^{(i)}|}$$

represents a correlation between the data sample p and the selected component $v^{(i)}$, in which $|p \cdot v^{(i)}|$ represents an inner product of this sample and the component. When the data sample p and the selected component $v^{(i)}$ are both normalized, $|p \cdot v^{(i)}|$ represents the cosine value of the differential angle between the data sample and the selected component. In Equation (6), $\alpha_2$ is a scaling factor which is typically positive.

It will be appreciated that Equation (6) is given for illustration, and there are many other methods to determine the adjusting weight based on the correlation, as long as the adjusting weight is positively related to the correlation.

In some further embodiments, the adjusting weight for each data sample may be further updated in each iteration based on the strength of the data sample. That is, an adjusting weight for each data sample may not only be initialized based on the strength as discussed at step 401, but also updated based on this strength at step 404. In one example, the adjusting weight may be updated as a combination of the weight calculated based on the correlation and the weight calculated based on the strength.

It will be appreciated that in any one of the plurality of iterations in the process 400, the adjusting weight for a given data sample may be determined based on its correlation with the selected component, its strength, or the combination thereof. The scope of the subject matter disclosed herein is not limited in this regard.

It is noted that in each iteration, the updated adjusting weight is applied to the original data samples of the input audio content at step 401. By iteratively updating the adjusting weights for respective data samples, data samples close to the selected component may be weighted by higher adjusting weights, and other data samples may be weighted by lower adjusting weights. As a result, the selected component may be rotated towards to a real source direction among the data samples.

According to the process 400, one source direction may be determined from the data samples based on the selected component. Take FIG. 3 as an example. Suppose that the first principal component is a selected component used as a basis of the updating of the adjusting weights. The direction of the first principal component PCA1 is moved towards the direction d1 based on the iteratively weighted data samples. After the iterative process 400 is converged, the direction of the first principal component PCA1 may be considered as one source direction of the input audio content.

In many use cases, there may be more than one audio source contained in the audio content and it is desired to estimate source directions of all the audio sources for subsequent source separation. In some embodiments, the process 400 may be iteratively performed for multiple times so as to obtain source directions in respective iterations.

Before a next round of source direction estimation, in some embodiments disclosed herein, each of the data samples around the previously-obtained source directions may be masked or suppressed with a weight (referred to as a masking weight hereinafter) in order to reduce their impacts on the estimation of the next source direction, otherwise the same or similar source direction may be estimated. The reason is that according to the sparsity assumption of the audio signal, each data sample in a time-frequency tile generally belongs to one dominant audio source (which is corresponding to one source direction). If a data sample is determined to be correlated to one source direction, it may not probably be correlated with other source directions and thus may not be used for estimating other source directions.

In some embodiments disclosed herein, a masking weight for each data sample may be determined based on the correlation between the data sample and a previously-obtained source direction. The masking value may be negatively correlated with the correlation in one embodiment. In this sense, the higher the correlation, the lower value the masking weight would be set to. As such, the corresponding data sample may be suppressed or masked, and another source direction may be estimated from the remaining data samples in the next round of source direction estimation.

Still take FIG. 3 as an example. Suppose that after the first round of iterative weighted source direction estimation, the direction of the first principal component PCA1 is converged to the direction d1 and is considered as a source direction of input audio content. In order to estimate another source direction, data samples along the direction d1 may be suppressed or sometimes completely masked. Then in a next round of source direction estimation, by re-applying the iterative weighted component analysis (for example, PCA analysis) as discussed above to the remaining data samples, the direction of the regenerated first principal component may probably indicate the direction d2 as another source direction of the audio content.

Figure 5:
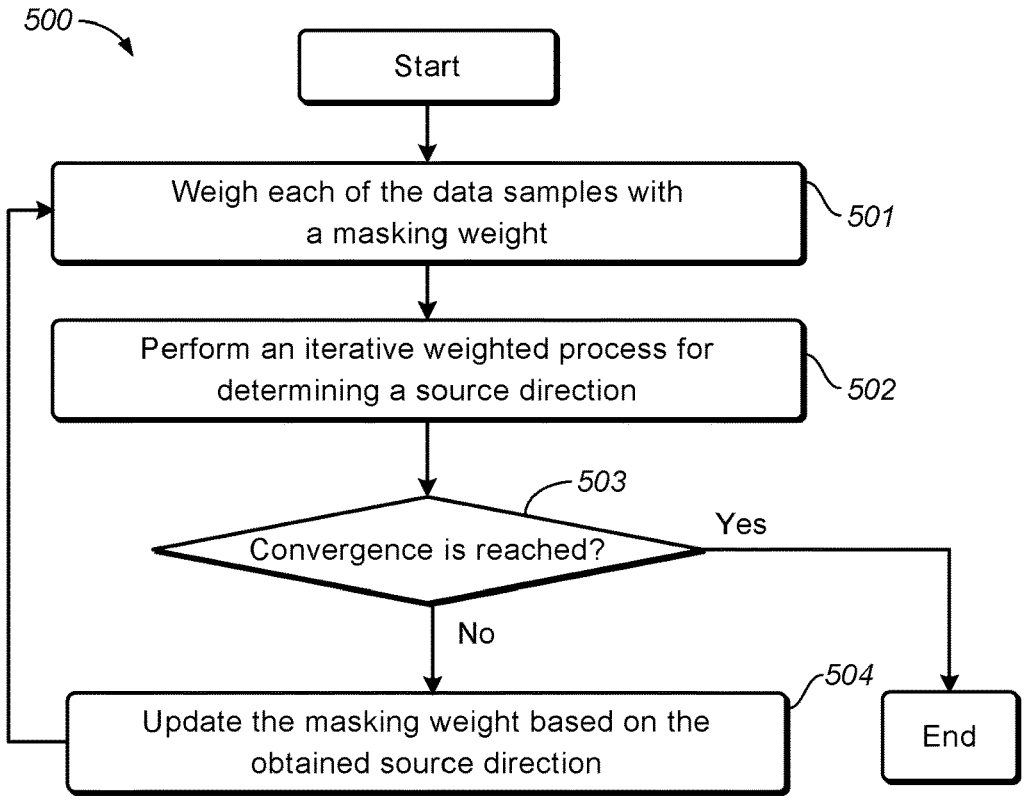
FIG. 5 illustrates a flowchart of a process for determining multiple source directions of audio content in accordance with an example embodiment disclosed herein.

FIG. 5 depicts a flowchart of a process for determining multiple source directions of audio content 500 in accordance with an example embodiment disclosed herein. The process 500 may also be an iterative process, in each iteration of which one source direction may be estimated.

As shown, the process 500 is entered at step 501, where each of data samples is weighted with a masking weight. In each iteration of the process 500, the data samples to be weighted at this step are those obtained from input audio content. In the first iteration, since no source direction is obtained previously, in one embodiment, the masking weight for each data sample may be initially set as 1. That is, all the data samples obtained from the audio content are not masked or suppressed. In the subsequent iterations, the masking weight for each data samples will be updated, which will be described below. The updated masking weights will be used to weight the data samples obtained from the audio content in subsequent iterations.

At step 502, an iterative weighted process is performed to determine a source direction based on the weighted data samples.

The iterative weighted process may be the process for determining a source direction of audio content 400 as described with reference to FIG. 4. It is noted that in the weighting step of the iterative weighted process, for example, in step 401, the adjusting weights are applied to the data samples weighted by the masking weights.

After the iterative weighted process is performed, for example, after the process 400 ends, a source direction may be determined based on the data samples weighted by the respective masking weights.

The process 500 proceeds to step 503, where it is determined whether a convergence condition is reached. If the convergence condition is reached (Yes at step 503), the iterative process 500 ends. If the convergence condition is not reached (No at step 503), the process 500 proceeds to step 504.

In some embodiments disclosed herein, the convergence condition may be based on strengths (or variance) of the remaining data samples after the weighting of step 501. If the sum of the strengths of the remaining data samples used for a next round of direction estimation is low (for example, lower than a threshold), the iterative process 500 is converged.

In some embodiments disclosed herein, the convergence condition may be based on the masking weights determined for the data samples. If all or most of the masking weights are small (for example, smaller than a threshold), the iterative process 500 is converged.

In some other embodiments disclosed herein, the convergence condition may be based on a predetermined number of iterations, for example, 3, 5, 10, or the like. The number of audio sources may be preconfigured in some cases. Since the number of the audio sources is corresponding to the number of source directions in the panning matrix, in these cases, the number of iterations in the process 500 may be set as the preconfigured number of audio sources, having one source direction obtained in each iteration. When a preconfigured number of iterations are performed, the convergence condition is satisfied and the process 500 ends.

It is noted that the iterative process 500 may be converged based on any other convergence conditions, and the scope of the subject matter disclosed herein is not limited in this regard.

If the convergence condition is reached at step 503, the process 500 ends and multiple source directions are obtained for subsequent source separation in the input audio content.

If the convergence condition is not reached at step 503, the process 500 proceeds to step 504. At step 504, the masking weight for each of the data samples is updated based on the source direction obtained at step 502. The updated masking weights are used in the weighting at step 501 in a next iteration.

In some embodiments disclosed herein, a masking weight for each of the data samples may be updated based a correlation between a direction of this data sample and the obtained source direction. The correlation between the direction of the data sample and the source direction may be estimated in a similar way as discussed above with respect to the correlation between a direction of a data sample and a direction indicated by a component.

In one embodiment, the correlation may be based on a differential angle between the direction of the data sample and the source direction. For example, the correlation between a data sample p and a source direction d may be represented as $$\frac{|p \cdot d|}{|p||d|},$$

in which |p·d| represents an inner product of this sample and the source direction. When the data sample p and the amplitude of the source direction d are both normalized, |p·d| represents the cosine value of the differential angle between the data sample and the source direction.

In some embodiments disclosed herein, if the correlation between a given data sample and the obtained source direction is high, which means that this data sample may belong to an audio source in the source direction, then the corresponding masking weight may be set as a low value from 0 to 1 in order to mask this data sample from the next round of source direction estimation. Otherwise, the masking weight may be determined as a high value from 0 to 1.

In some embodiments disclosed herein, the masking weight for each of the data samples may be determined based on a difference between the correlation for the data sample and a predetermined threshold.

In one embodiment, based on the comparison result of the correlation and the threshold, the masking weight may be binary, for example may be set as either 0 or 1. In this embodiment, when a data sample is determined to be located around the source direction obtained in the current iteration based on the computed correlation, this data sample may be completely masked with a masking weight, 0. Otherwise, the data sample is maintained for the next iteration by applying a masking weight, 1. The binary masking weight may be determined as below:

$$w_p^{mask} = \begin{cases} 0 & r \geq r_0 \\ 1 & r < r_0 \end{cases} \tag{7}$$

where $w_p^{mask}$ represents a masking weight for a data sample p, r represents the correlation between the direction of the data sample p and the obtained source direction d, which may be determined as $$\frac{|p \cdot d|}{|p||d|}$$

in one example, and $r_0$ represents a predetermined threshold for the correlation.

According to Equation (7), if the correlation for a given data sample is higher than or equal to the threshold, which means that this data sample is highly correlated to the already-determined source direction, then a masking weight of 0 may be applied to the data sample to completely mask it. If the correlation for a given data sample is lower than the threshold, then this data sample may remain unchanged by applying a masking weight of 1.

In another embodiment, a masking weight may be set as a continuous value ranging from 0 to 1. The continuous masking value may be determined by a sigmoid function of the correlation in one example, which may be represented as below:

$$w_p^{mask} = \frac{1}{1 + e^{\beta(r - r_0)}} \tag{8}$$

where $w_p^{mask}$ represents a masking weight for a data sample p, r represents the correlation between the direction of the data sample p and the obtained source direction d, which may be determined as $$\frac{|p \cdot d|}{|p||d|}$$

in one example, $r_0$ represents a predetermined threshold, and the factor β defines the shape of the sigmoid function which is typically positive.

According to the sigmoid function in Equation (8), it can be seen that if the correlation for a given data sample is higher than or equal to the threshold, the corresponding masking weight may be calculated as a low value from 0 to 1, for example. In this case, the data sample is heavily masked. If the correlation for a given data sample is lower than the threshold, the corresponding masking weight may be calculated as a high value from 0 to 1, for example. In this case, the data sample is slightly masked.

It should be noted that there are many other functions other than the sigmoid function designed to set a continuous masking weight, and the scope of the subject matter disclosed herein is not limited in this regard. For example, a linear function based on the correlation may be used to set a masking weight for a data sample as a continuous value from 0 to 1.

As can be seen from the above, when determining the masking weights for all the data samples, the threshold $r_0$ may be set to be a value so that data samples along the previously-determined direction of an audio source may be fully masked, while data samples from other audio sources are not suppressed. In one example, the threshold $r_0$ may be set as a fixed value based on the analysis of the correlations between the previously-determined source direction and directions of the respective data samples.

In some embodiments disclosed herein, the threshold $r_0$ may be determined based on a distribution of the correlations between the previously-determined source direction and directions of the respective data samples.

Figure 6:
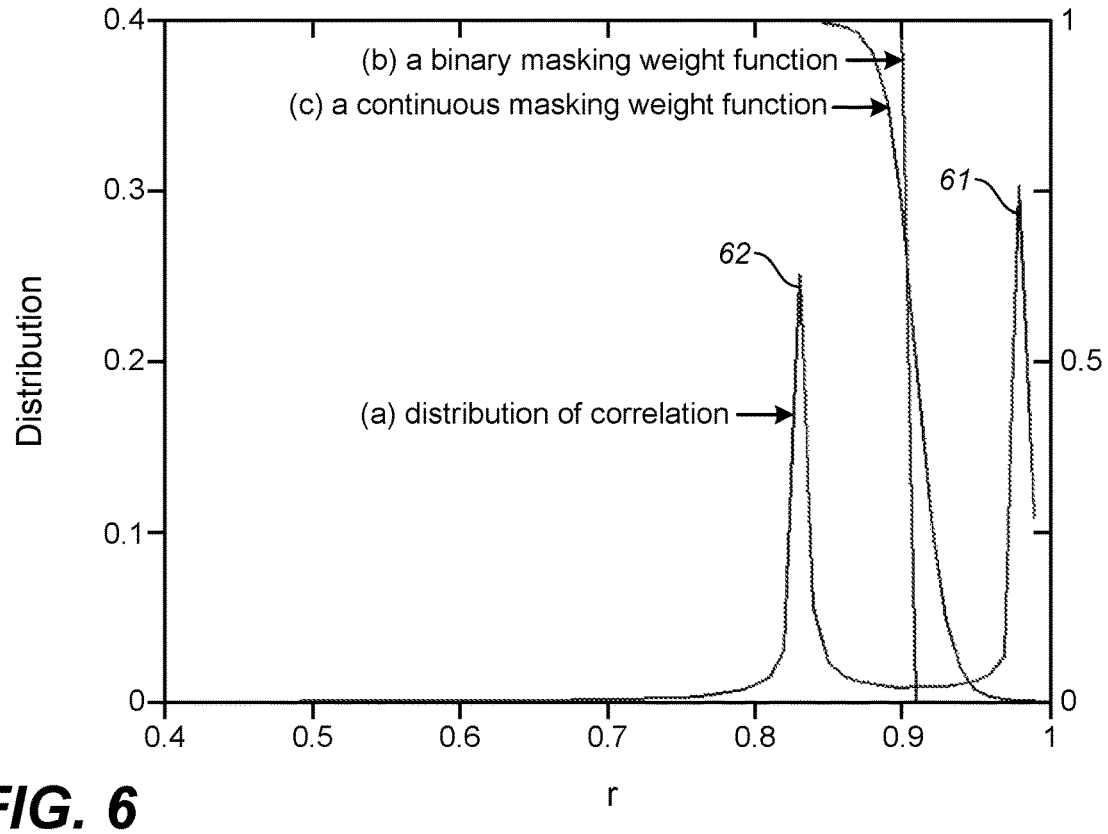
FIG. 6 illustrates a schematic diagram of a distribution of correlations between a source direction and directions of data samples in accordance with an example embodiment disclosed herein.

FIG. 6 depicts a schematic diagram of a distribution of correlations between a source direction and directions of data samples in accordance with an example embodiment disclosed herein. The data samples considered in FIG. 6 may be those plotted in FIG. 1 and FIG. 3. As can be seen, there are two distinct peaks 61 and 62 in the curve (a) shown in FIG. 6, corresponding to the two audio sources respectively. The peak 61 that is close to the correlation r=1 represents the data samples along the already-detected source direction d1, and the other peak 62 represents the other source in the source direction d2, which is not detected yet. It will be appreciated that there will be more than two peaks in the distribution if there are more than two audio sources contained in the audio content.

In some embodiments disclosed herein, the threshold $r_0$ may be determined by the two peaks at the most right side (one is corresponding to the detected source direction, and the other is corresponding to the source direction closest to the detected one) in the distribution of correlations. For example, the threshold $r_0$ may be set as a random value between the correlations of the two peaks. It will be appreciated that the threshold may be determined by other distinct peaks in the distribution, and the scope of the subject matter disclosed herein is not limited in this regard.

In some other embodiments disclosed herein, each of the two regions represented by the two peaks with the highest correlations (for example, those close to r=1) may be fit as a Gaussian model, represented by $w_1G(x|\mu_1,\sigma_j)$ and $w_2G(x|\mu_2,\sigma_2)$ respectively. $\mu_i$ and $\sigma_i$ are the means and standard deviations of the two Gaussian models, and $w_1$ and $w_2$ are the corresponding prior (intuitively the heights of the two peaks). In one embodiment, based on the Bayesian theory, $r_0$ can be selected as the point where gives the least error rate. For example, $r_0$ may be solved by the following equation:

$$w_1G(x|\mu_1,\sigma_1)=w_2G(x|\mu_2,\sigma_2) \tag{9}$$

In one example, the threshold $r_0$ is calculated as 0.91. As shown in FIG. 6, the curve (b) depicts a function for determining a binary masking weight. In this example, when the correlation between a direction of a data sample and the previously-obtained source direction is larger than or equal to the threshold 0.91, the masking weight is set to be as 0. Otherwise, the masking weight is 1. The curve (c) shown in FIG. 6 depicts a function for determining a continuous masking weight. In this example, the masking weight is continuous in the range from 0 to 1. When the correlation is larger than or equal to the threshold 0.91, the masking weight is set to be a relatively high value. Otherwise, the masking weight may be set as a low value.

The determination for the masking weight is described above. It will be appreciated that in one of the plurality of iterations to be performed in the process 500, the masking weight for a data sample may be updated either as a binary value based on Equation (7) or a continuous value based on Equation (8). The scope of the subject matter disclosed herein is not limited in this regard.

It is noted that in each iteration of the process 500, the updated masking weights are applied to the original data samples of the input audio content at step 501. In each iteration of the process 500, one source direction is obtained at step 502. When the process 500 is converged, multiple source directions may be detected from the audio content.

In some embodiments disclosed herein, audio source separation may be performed based on the multiple detected source directions and the number of the source directions. The number of the detected source directions may indicate the number of audio sources to be separated.

Based on the mixed model illustrated in Equations (1) and (2), the detect source directions may be used to constructed the panning matrix A, each corresponding to one column in the matrix. A source direction may be an M-dimensional vector, where M represents the number of observed mono signals in the input audio content. Suppose that N source directions are detected from the audio content. The panning matrix A may then be constructed as an M-by-N panning matrix. With the panning matrix A constructed, the unknown source signals S(t) can be reasonably estimated by many methods.

In one example embodiment, the source signals S(t) may be estimated by directly inversing the panning matrix A, for example, by $S(t)=A^{-1}X(t)$. In this embodiment, the uncorrelated components have been removed through direct and ambiance decomposition of the audio content.

In another example embodiment, if the panning matrix A is not invertible or if the audio content X(t) still contains some of the noise/ambiance components, the source signals S(t) may be estimated by minimizing $\|X(t)-AS(t)\|^2$.

In yet another example embodiment, the panning matrix A may be used to initialize corresponding spectral or spatial parameters used for audio source separation, and then the panning matrix A may be refined and audio source signals may be estimated by non-negative matrix factorization (NMF) for example.

It will be appreciated that the detected source directions and the number of the source directions are used to assist audio source separation from the input audio content. Any methods, either currently existing or future developed, can be adopted for audio source separation based on the detected source directions. The scope of the subject matter disclosed herein is not limited in this regard.

Among the multiple detected source directions, some source directions may correspond to the same audio source even the masking weights described above are applied to avoid this condition. The redundant source directions pointing to the same audio source may be discarded in some embodiments disclosed herein.

The directions corresponding to the same source may still have some difference if comparing their angles. This is possible to happen in the complex realistic audio signals. For example, two or multiple directions may be detected for the same source when the source is moving (which means the source direction of this source is not static), or when the source is largely interfered by noises or other signals (which means the lobe of the data samples along the true source direction is large). Merging these directions by analyzing the correlation or angles among them may not really work since the threshold for the correlation or angel is hard to tune. In some cases, some individual audio sources may be even closer to each other than the multiple directions detected for the same source.

In some further embodiments disclosed herein, an incremental pre-demixing of the audio content is applied to prune the obtained source directions so as to discard redundant source directions. The pre-demixing of the audio content involves separating audio sources from the audio content, which is similar to what is described above. In these embodiments, the obtained source directions rather than the discarded source directions may be confirmed for the real source separation in subsequent processing.

Specifically, since there may always be at least one audio source contained in the audio content, at least one source direction may be first selected from the detected source directions as a confirmed source direction. A confirmed source direction may not be discarded and may be used for real source separation. Several iterations would be performed to detect whether any of the remaining source directions is a redundant source direction or a confirmed source direction by pre-demixing the audio content.

In some embodiments disclosed herein, for a given source direction in the remaining source directions other than the confirmed source direction, the audio content may be pre-demixed based on the confirmed source direction and the given source direction, so as to separate audio sources from the audio content. The audio source separation here is based on a panning matrix constructed by the confirmed and the given audio source directions, which is similar to the processing of audio source separation as discussed above. After audio sources are separated by the pre-demixing, a similarity between the separated audio sources may be determined to evaluate whether duplicated audio sources are obtained when the given source direction is used for audio source separation. If it is determined that a duplicated audio source is introduced, the given source direction may be a redundant source direction and then may be discarded. Otherwise, the given source direction may be determined as a confirmed source direction. For any others among the detected source directions, the same process may be iteratively performed.

In one embodiment, if a detected source direction is determined as a confirmed source direction in a previous iteration, this confirmed source direction may be used together with other previously-determined confirmed source directions in the pre-demixing of the audio content in a next iteration. That is, there may be a confirmed direction pool which is initialized with one source direction selected from the multiple detected source directions. Any source direction that is verified as a confirmed source direction may be added into this pool. Otherwise, the source direction may be discarded. After all the detected source directions are verified, the source directions remained in the confirmed direction pool may be used for subsequent source separation from the audio content.

Figure 7:
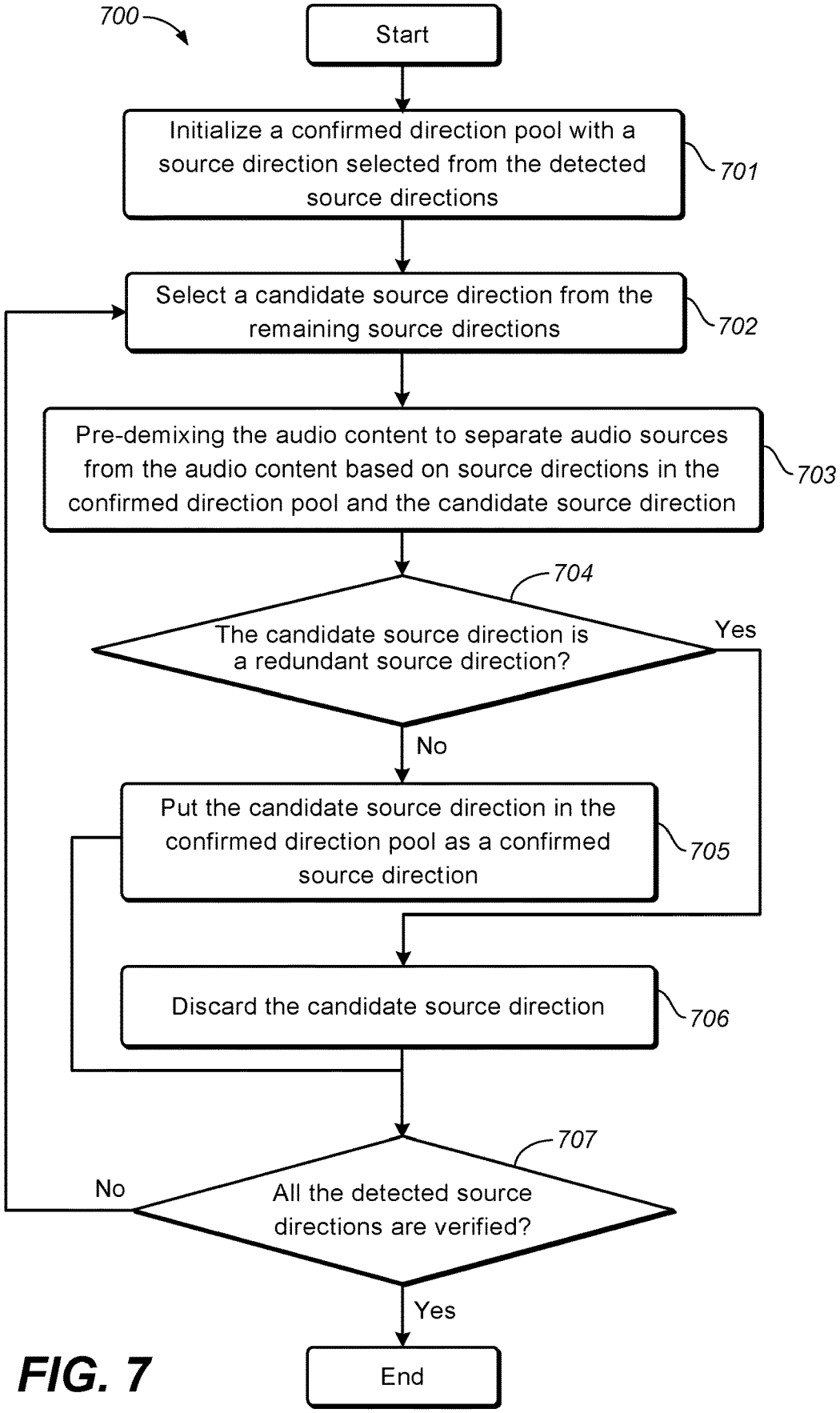
FIG. 7 illustrates a flowchart of a process for determining confirmed source directions from multiple detected audio sources in accordance with an example embodiment disclosed herein.

FIG. 7 depicts a flowchart of a process for determining confirmed source directions from multiple detected audio sources 700 in accordance with an example embodiment disclosed herein.

As shown, the process 700 is entered at step 701, where a confirmed direction pool is initialized with a source direction selected from the detected source directions.

The initialized source direction may be randomly selected in one example embodiment. In another example embodiment, the initialized source direction may be selected based on the strengths of the detected source directions. For example, the source direction with the highest strength among the detected source directions may be selected. In yet another example embodiment, the source direction with the highest correlation between the data samples may be selected. The scope of the subject matter disclosed herein is not limited in this regard.

At step 702, a candidate source direction is selected from the remaining source directions. The remaining source directions are the detected source directions other than those contained in the confirmed direction pool and those discarded.

The candidate source direction may be randomly selected from the remaining source directions in one example embodiment. In another example embodiment, the source direction corresponding to the highest strength among the remaining source directions may be selected as a candidate source direction. In yet another example embodiment, the source direction with the highest correlation between the data samples may be selected from the remaining source directions as a candidate source direction. The scope of the subject matter disclosed herein is not limited in this regard.

At step 703, the audio contend is pre-demixed to separate audio sources from the audio content based on the source directions in the confirmed direction pool and the candidate source direction. The confirmed source directions as well as the candidate source direction are used to construct a panning matrix for the pre-demixing of the audio content. The source separation may be performed based on the constructed panning matrix, which is described above.

At step 704, it is determined whether the candidate source direction is a redundant source direction. The determination in this step is based on the pre-demixing result at step 703.

In one embodiment, a similarity between the separated audio sources may be determined and used to evaluate whether identical audio sources are obtained when the candidate source direction is added to the panning matrix for source separation. If the similarity between the separated sources is higher than a threshold, or is much higher than the similarity determined in a previous iteration of the process 700, it means that an identical audio source is introduced and then the candidate source direction is a redundant source direction.

Any currently existing or future developed methods for determining the similarity of audio source signals may be adopted, and the scope of the subject matter disclosed herein is not limited in this regard. By way of example, a frequency spectral similarity between the separated audio sources may be estimated.

Additionally or alternatively, in order to decide whether the candidate source direction is confirmed to be used for source separation, the energies of the separated audio sources obtained after the pre-demixing may be determined. If one or some of the energies are abnormal, the candidate source direction may be a redundant source direction. Otherwise, the candidate source direction may be added to the confirmed direction pool.

Additionally or alternatively, if the inverse matrix of the panning matrix, for example, the matrix $A^{-1}$ becomes ill-conditioned during the pre-demixing of the audio content when the candidate direction is added into the panning matrix, the candidate source direction may be a redundant source direction. The ill-condition of the inverse panning matrix may make the energy of a separated audio source or the entry values of the inverse matrix become abnormal. In this sense, the candidate source direction may not be determined as a confirmed source direction for subsequent audio source separation.

If the candidate source direction is determined as a redundant source direction (Yes at step 704), the process 700 proceeds to step 706. At step 706, the candidate source direction is discarded. The process 700 then proceeds to step 707.

If the candidate source direction is not determined as a redundant source direction (No at step 704), the process 700 proceeds to step 705. At step 705, the candidate source direction is added into the confirmed direction pool as a confirmed source direction. The process 700 then proceeds to step 707.

At step 707, it is determined that whether all the detected source directions are verified. If each of all the detected source directions is either determined as a confirmed source direction or discarded, the process 700 ends. Otherwise, the process 700 returns back to step 702 until all the detected source directions are verified.

After the process 700 is performed, source directions contained in the confirmed direction pool may be used for audio source separation from the audio content. The number of the audio sources to be separated may be determined based on the number of confirmed source directions accordingly.

Figure 8:
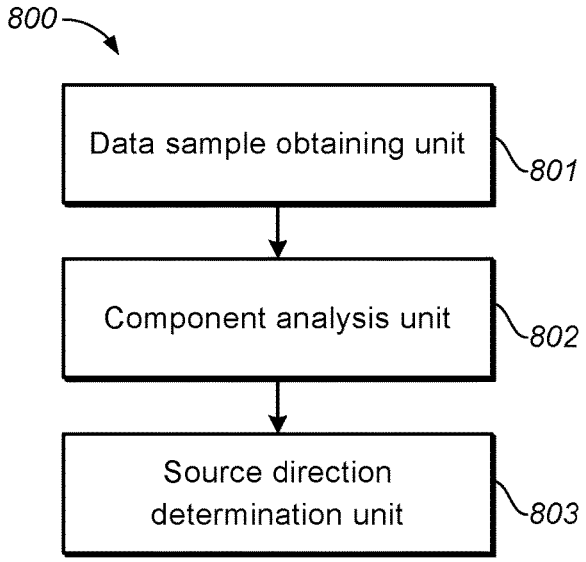
FIG. 8 illustrates a block diagram of a system of separating audio sources in audio content in accordance with one example embodiment disclosed herein.

FIG. 8 depicts a block diagram of a system of separating audio sources in audio content 800 in accordance with one example embodiment disclosed herein. The audio content includes a plurality of channels. As depicted, the system 800 includes a data sample obtaining unit 801 configured to obtain multiple data samples from multiple time-frequency tiles of the audio content. The system 800 also includes a component analysis unit 802 configured to analyze the data samples to generate multiple components in a plurality of iterations, wherein each of the components indicates a direction with a variance of the data samples, and wherein in each of the plurality of iterations, each of the data samples is weighted with a weight that is determined based on a selected component from the multiple components. The system 800 further includes a source direction determination unit 803 configured to determine a source direction of the audio content based on the selected component for separating an audio source from the audio content.

In some embodiments disclosed herein, the selected component may indicate a direction with the highest variance of the data samples in each of the plurality of iterations.

In some embodiments disclosed herein, the component analysis unit 802 may be configured to for each of the plurality of iterations, weight each of the data samples, analyze the weighted data samples to generate multiple components, and determine a weight for each of the data samples in the weighting in a next iteration based on the selected component from the multiple components.

In some embodiments disclosed herein, the component analysis unit 802 may be configured to determine a weight for each of the data samples based on a correlation between a direction of the data sample and a direction indicated by the selected component. The weight may be positively related to the correlation.

In some embodiments disclosed herein, the component analysis unit 802 may be configured to determine a weight for each of the data samples based on a strength of the data sample. The weight may be positively related to the strength.

In some embodiments disclosed herein, the system 800 may further comprise a component adjusting unit configured to adjust the selected component by a predetermined offset value in one of the plurality of iterations.

In some embodiments disclosed herein, the weight mentioned above is a first weight and the plurality of iterations mentioned above are a first plurality of iterations. In these embodiments, the system 800 may further comprise an iterative performing unit configured to perform the first plurality of iterations and the determining in a second plurality of iterations to obtain multiple source directions for separating audio sources from the audio content. In each of the second plurality of iterations, each of the data samples is weighted with a second weight that is determined based on an obtained source direction.

In some embodiments disclosed herein, the iterative performing unit may be configured to for each of the second plurality of iterations, weight each of the data samples with the second weight, perform the first plurality of iterations and the determining based on the weighted data samples to obtain a source direction, and determine the second weight for each of the data samples in the weighting in a next iteration of the second plurality of iterations based on the source direction.

In some embodiments disclosed herein, the iterative performing unit may be configured to determine the second weight for each of the data samples based on a difference between a predetermined threshold and a correlation of a direction of the data sample and the source direction. The second weight may be negatively related to the correlation.

In some embodiments disclosed herein, the threshold may be determined based on a distribution of correlations between directions of the data samples and the source direction.

In some embodiments disclosed herein, the system 800 may further comprise a source direction pruning unit configured to prune the obtained source directions to discard a redundant source direction by pre-demixing the audio content based on the obtained source directions.

In some embodiments disclosed herein, the source direction pruning unit may be configured to select a source direction from the source directions as a confirmed source direction, and for a given source direction from the remaining source directions, pre-demix the audio content based on the confirmed source direction and the given source direction to separate audio sources from the audio content, determine a similarity between the separated audio sources, determine whether the given source direction is a redundant source direction or a confirmed source direction based on the similarity, and discard the given source direction in response to determining that the given source direction is a redundant source direction.

For the sake of clarity, some optional components of the system 800 are not shown in FIG. 8. However, it should be appreciated that the features as described above with reference to FIGS. 2 and 4-7 are all applicable to the system 800. Moreover, the components of the system 800 may be a hardware module or a software unit module. For example, in some embodiments, the system 800 may be implemented partially or completely as software and/or in firmware, for example, implemented as a computer program product embodied in a computer readable medium. Alternatively or additionally, the system 800 may be implemented partially or completely based on hardware, for example, as an integrated circuit (IC), an application-specific integrated circuit (ASIC), a system on chip (SOC), a field programmable gate array (FPGA), and so forth. The scope of the subject matter disclosed herein is not limited in this regard.

Figure 9:
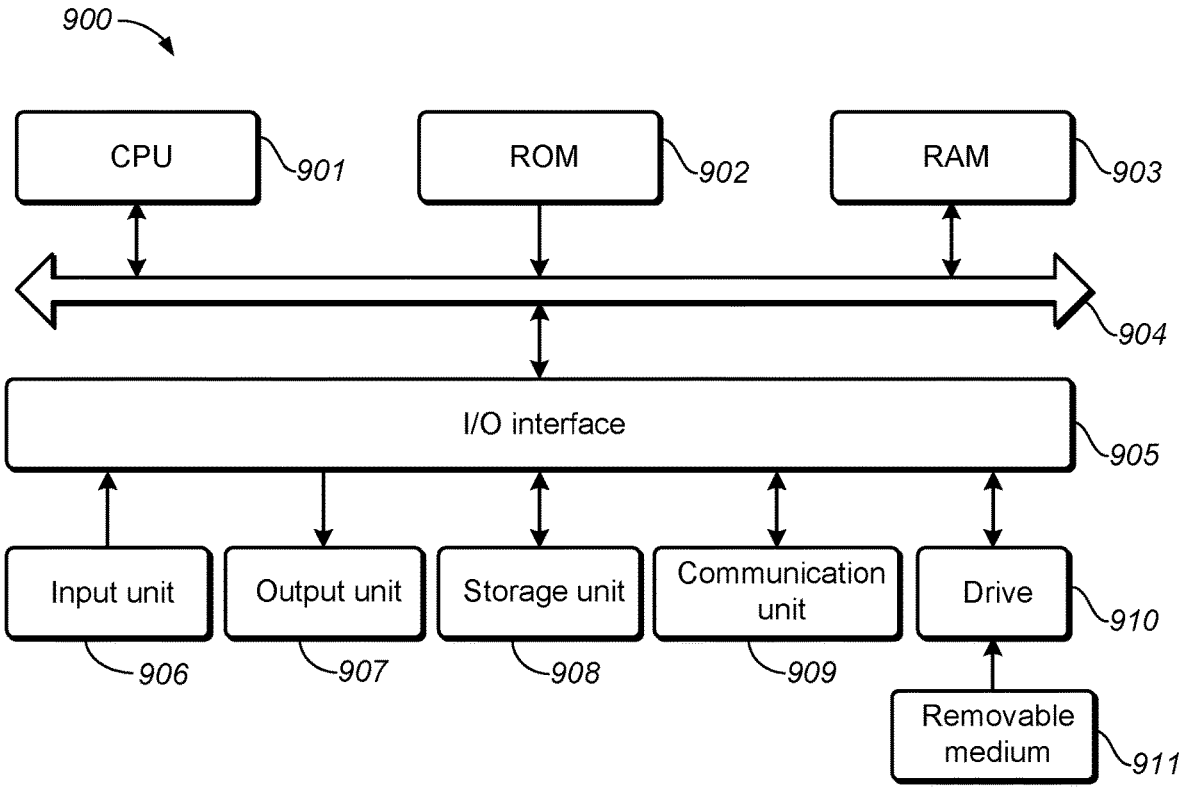
FIG. 9 illustrates a block diagram of an example computer system suitable for implementing example embodiments disclosed herein.

FIG. 9 depicts a block diagram of an example computer system 900 suitable for implementing example embodiments disclosed herein. As depicted, the computer system 900 comprises a central processing unit (CPU) 901 which is capable of performing various processes in accordance with a program stored in a read only memory (ROM) 902 or a program loaded from a storage unit 908 to a random access memory (RAM) 903. In the RAM 903, data required when the CPU 901 performs the various processes or the like is also stored as required. The CPU 901, the ROM 902 and the RAM 903 are connected to one another via a bus 904. An input/output (I/O) interface 905 is also connected to the bus 904.

The following components are connected to the I/O interface 905: an input unit 906 including a keyboard, a mouse, or the like; an output unit 907 including a display such as a cathode ray tube (CRT), a liquid crystal display (LCD), or the like, and a loudspeaker or the like; the storage unit 908 including a hard disk or the like; and a communication unit 909 including a network interface card such as a LAN card, a modem, or the like. The communication unit 909 performs a communication process via the network such as the internet. A drive 910 is also connected to the I/O interface 905 as required. A removable medium 911, such as a magnetic disk, an optical disk, a magneto-optical disk, a semiconductor memory, or the like, is mounted on the drive 910 as required, so that a computer program read therefrom is installed into the storage unit 908 as required.

Specifically, in accordance with example embodiments disclosed herein, the method or processes described above with reference to FIGS. 2, 4, 5, and 7 may be implemented as computer software programs. For example, example embodiments disclosed herein comprise a computer program product including a computer program tangibly embodied on a machine readable medium, the computer program including program code for performing the method 200, or the process 400, 500, or 700. In such embodiments, the computer program may be downloaded and mounted from the network via the communication unit 909, and/or installed from the removable medium 911.

Generally speaking, various example embodiments disclosed herein may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments disclosed herein are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, example embodiments disclosed herein include a computer program product comprising a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include, but not limited to, an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing.

Computer program code for carrying out methods disclosed herein may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server. The program code may be distributed on specially-programmed devices which may be generally referred to herein as "modules". Software component portions of the modules may be written in any computer language and may be a portion of a monolithic code base, or may be developed in more discrete code portions, such as is typical in object-oriented computer languages. In addition, the modules may be distributed across a plurality of computer platforms, servers, terminals, mobile devices and the like. A given module may even be implemented such that the described functions are performed by separate processors and/or computing hardware platforms.

As used in this application, the term "circuitry" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present. Further, it is well known to the skilled person that communication media typically embodies computer readable instructions, data structures, program modules or other data in a modulated data signal such as a carrier wave or other transport mechanism and includes any information delivery media.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of the subject matter disclosed herein or of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination.

Various modifications, adaptations to the foregoing example embodiments disclosed herein may become apparent to those skilled in the relevant arts in view of the foregoing description, when read in conjunction with the accompanying drawings. Any and all modifications will still fall within the scope of the non-limiting and example embodiments disclosed herein. Furthermore, other embodiments disclosed herein will come to mind to one skilled in the art to which these embodiments pertain having the benefit of the teachings presented in the foregoing descriptions and the drawings.

Accordingly, the present subject matter may be embodied in any of the forms described herein. For example, the following enumerated example embodiments (EEEs) describe some structures, features, and functionalities of some aspects of the subject matter disclosed herein.

EEE 1. A method of estimating source directions and the source number in multichannel audio content includes:

Applying an iterative weighted PCA analysis on data samples of the audio content in multiple iterations so as to detect a first source direction;

Applying respective masking weights on the data samples and applying iterative weighted PCA on the weighted data samples in multiple iterations so as to detect more source directions; and Pre-demixing the audio content to prune the detected source directions and estimating the source number accordingly.

EEE 2. The method according to EEE 1, the iterative weighted PCA analysis includes the following steps:

Step 1: representing the data samples in a multi-dimensional space, and applying PCA analysis or weighted PCA analysis on the data samples to find the direction of the first principal component;

Step 2: updating a weight for each data sample, and weighting the data samples with the respective updated weight;

Step 3: reapplying PCA analysis on the weighted data samples to find the corresponding principal component; and Step 4: repeating steps 2 and 3 for multiple times until convergence is reached.

EEE 3. The method according to EEE 2, the weight for each data sample is positively related to the correlation between the data sample and the detected first principal component at the previous iteration.

EEE 4. The method according to EEE 2 or 3, the weight for each data sample is additionally based on the amplitude or energy of the data sample.

EEE 5. The method according to EEE 2, the detected principal component is adjusted by a random small delta vector.

EEE 6. The method according to EEE 1, the masking weight of each data sample is negatively related to the correlation between the data sample and the detected source direction, and is determined based on a threshold calculated from the statistical distribution of the correlations between the source direction and the data samples.

EEE 7. The method according to EEE 6, the threshold is determined based on the two peaks closest to the correlation r=1 (for example, at the right most end) in the correlation distribution by fitting each of the peaks as a Gaussian model with its height as prior, and solving Equation (9) for the least error rate.

EEE 8. The method according to EEE 1, the pruning of the detected source direction includes:

Step a: initializing a confirmed direction pool by the most significant source direction (for example, based on their strengths) among the detected source directions;

Step b: selecting a candidate source direction (typically the most significant one) among the left source directions and adding the selected source direction to the confirmed direction pool;

Step c: performing pre-demixing operations on the audio content by using the source directions in the confirmed direction pool, so as to extract corresponding audio sources from the audio content;

Step d: verifying if some of the extracted audio sources are identical or their energies are abnormal;

Step e: if yes at step d, the candidate source direction is removed from the confirmed direction pool; otherwise, the candidate source direction is kept in the confirmed direction pool; and Step f: repeating steps b to e until all the detected source directions are verified.

It will be appreciated that the embodiments of the subject matter are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A method of separating audio sources in audio content, the audio content including a plurality of channels, the method comprising:

obtaining multiple data samples from multiple time-frequency tiles of the audio content;

analyzing the data samples to generate multiple components in a plurality of iterations, wherein the multiple components are extracted by principal component analysis and each of the components indicates a direction with a variance of the data samples, and wherein analyzing the data samples comprises, in each of the plurality of iterations:

weighting each of the data samples by a respective weight, wherein the plurality of iterations comprise an iteration in which a first weight assigned to a first data sample of the data samples is higher than a second weight assigned to a second data sample of the data samples;

analyzing the weighted data samples to generate multiple components;

selecting a component from the multiple components; and determining, for the weighting of the data samples in a next iteration, the respective weight for each of the data samples based on the selected component; and determining a source direction of the audio content based on the selected component for separating an audio source from the audio content.

2. The method according to claim 1, wherein the selected component indicates a direction with the highest variance of the data samples in each of the plurality of iterations.

3. The method according to claim 1, wherein determining the respective weight for each of the data samples comprises:

determining the respective weight for each of the data samples based on a correlation between a direction of the data sample and a direction indicated by the selected component, wherein the respective weight is positively related to the correlation.

4. The method according to claim 1, wherein determining the respective weight for each of the data samples comprises:

determining the respective weight for each of the data samples based on a strength of the data sample, wherein the respective weight is positively related to the strength.

5. The method according to claim 1, further comprising:

adjusting the selected component by a predetermined offset value in one of the plurality of iterations.

6. The method according to claim 1, wherein the weight is a first weight and the plurality of iterations are a first plurality of iterations, and wherein the method further comprises:

performing, in each of a second plurality of iterations, the analyzing the data samples in the first plurality of iterations and the determining a source direction of the audio content, to thereby obtain multiple source directions for separating audio sources from the audio content, wherein in each of the second plurality of iterations, each of the data samples is weighted with a respective second weight that is determined based on a previously obtained source direction.

7. The method according to claim 6, wherein performing the analyzing the data samples in the first plurality of iterations and the determining a source direction of the audio content comprises, for each of the second plurality of iterations:

weighting each of the data samples with the respective second weight;

performing the analyzing the data samples in the first plurality of iterations and the determining the source direction of the audio content based on the weighted data samples, weighted with their respective second weights, to obtain a source direction; and determining, for the weighting of the data samples in a next iteration of the second plurality of iterations, the respective second weight for each of the data samples based on the obtained source direction.

8. The method according to claim 7, wherein determining the respective second weight for each of the data samples comprises:

determining the respective second weight for each of the data samples based on a difference between a predetermined threshold and a correlation of a direction of the data sample and the additional source direction, wherein the respective second weight is negatively related to the correlation.

9. The method according to claim 8, wherein the threshold is determined based on a distribution of correlations between directions of the data samples and the additional source direction.

10. The method according to claim 6, further comprising:

pruning the obtained source directions to discard a redundant source direction by demixing the audio content based on the obtained source directions.

11. The method according to claim 10, wherein pruning the obtained source directions comprises:

selecting a source direction from the source directions as a confirmed source direction; and for a given source direction from the remaining source directions:

demixing the audio content based on the confirmed source direction and the given source direction to separate audio sources from the audio content, determining a similarity between the separated audio sources, determining whether the given source direction is a redundant source direction or a confirmed source direction based on the similarity, and discarding the given source direction in response to determining that the given source direction is a redundant source direction.

12. A computer program product of separating audio sources in audio content, comprising a computer program tangibly embodied on a machine readable medium, the computer program containing program code for performing the method according claim 1.

13. A system of separating audio sources in audio content, the audio content including a plurality of channels, the system comprising:

a data sample obtaining unit configured to obtain multiple data samples from multiple time-frequency tiles of the audio content;

a component analysis unit configured to analyze the data samples to generate multiple components in a plurality of iterations, wherein the multiple components are extracted by principal component analysis and each of the components indicates a direction with a variance of the data samples, and wherein the component analysis unit is further configured to, in each of the plurality of iterations:

weight each of the data samples by a respective weight, wherein the plurality of iterations comprise an iteration in which a first weight assigned to a first data sample of the data samples is higher than a second weight assigned to a second data sample of the data samples;

analyze the weighted data samples to generate multiple components;

select a component from the multiple components; and determine, for the weighting of the data samples in a next iteration, the respective weight for each of the data samples based on the selected component; and a source direction determination unit configured to determine a source direction of the audio content based on the selected component for separating an audio source from the audio content.

14. The system according to claim 13, wherein the selected component indicates a direction with the highest variance of the data samples in each of the plurality of iterations.

15. The system according to claim 13, wherein the component analysis unit is configured to determine the respective weight for each of the data samples based on a correlation between a direction of the data sample and a direction indicated by the selected component, wherein the respective weight is positively related to the correlation.

16. The system according to claim 13, wherein the component analysis unit is configured to determine the respective weight for each of the data samples based on a strength of the data sample, wherein the respective weight is positively related to the strength.

17. The system according to claim 13, further comprising:

a component adjusting unit configured to adjust the selected component by a predetermined offset value in one of the plurality of iterations.

18. The system according to claim 13, wherein the weight is a first weight and the plurality of iterations are a first plurality of iterations, and wherein the system further comprises:

an iterative performing unit configured to perform, in each of a plurality of second iterations, the analysis of the data samples in the first plurality of iterations and the determination of a source direction of the audio content, to thereby obtain multiple source directions for separating audio sources from the audio content, wherein in each of the second plurality of iterations, each of the data samples is weighted with a respective second weight that is determined based on a previously obtained source direction.

19. The system according to claim 18, wherein the iterative performing unit is configured to, for each of the second plurality of iterations:

weight each of the data samples with the respective second weight;

perform the analysis of the data samples in the first plurality of iterations and the determination of a source direction of the audio content based on the weighted data samples, weighted with their respective second weights, to obtain a source direction; and determine, for the weighting of the data samples in a next iteration of the second plurality of iterations, the respective second weight for each of the data samples based on the obtained source direction.

20. The system according to claim 19, wherein the iterative performing unit is configured to determine the respective second weight for each of the data samples based on a difference between a predetermined threshold and a correlation of a direction of the data sample and the additional source direction, wherein the respective second weight is negatively related to the correlation.

21. The system according to claim 20, wherein the threshold is determined based on a distribution of correlations between directions of the data samples and the additional source direction.

22. The system according to claim 18, further comprising:

a source direction pruning unit configured to prune the obtained source directions to discard a redundant source direction by demixing the audio content based on the obtained source directions.

23. The system according to claim 22, wherein the source direction pruning unit is configured to:

select a source direction from the source directions as a confirmed source direction; and for a given source direction from the remaining source directions:

demix the audio content based on the confirmed source direction and the given source direction to separate audio sources from the audio content, determine a similarity between the separated audio sources, determine whether the given source direction is a redundant source direction or a confirmed source direction based on the similarity, and discard the given source direction in response to determining that the given source direction is a redundant source direction.

* * * * *